US008303389B2

(12) United States Patent
Wilm

(10) Patent No.: US 8,303,389 B2
(45) Date of Patent: Nov. 6, 2012

(54) ARRANGEMENT FOR ELECTRONICALLY CARRYING OUT BOARD ROLE-PLAY AND CARD GAMES

(75) Inventor: Robert Wilm, Dresden (DE)

(73) Assignee: Manfred Rietzler, Bangkok (TH)

( * ) Notice: Subject to any disclaimer, the term of this patent is extended or adjusted under 35 U.S.C. 154(b) by 693 days.

(21) Appl. No.: 11/921,980

(22) PCT Filed: Jun. 16, 2006

(86) PCT No.: PCT/EP2006/005771

§ 371 (c)(1),
(2), (4) Date: Oct. 14, 2009

(87) PCT Pub. No.: WO2006/136322

PCT Pub. Date: Dec. 28, 2006

(65) Prior Publication Data

US 2010/0032900 A1 Feb. 11, 2010

(30) Foreign Application Priority Data

Jun. 20, 2005 (DE) ..... 10 2005 028 522
Jun. 16, 2006 (DE) ..... 10 2006 014 940

(51) Int. Cl.
*G06F 17/00* (2006.01)

(52) U.S. Cl. ..... 463/11

(58) Field of Classification Search ..... None
See application file for complete search history.

(56) References Cited

U.S. PATENT DOCUMENTS 5,190,285 A 3/1993 Levy et al. ..... 273/85
5,853,327 A 12/1998 Gilboa ..... 463/39
6,234,902 B1 5/2001 Hazama ..... 463/43
2005/0031172 A1* 2/2005 Tumey et al. ..... 382/115
2005/0054408 A1 3/2005 Steil et al. ..... 463/11
2005/0090304 A1 4/2005 Crawford, III et al. ..... 463/13
2005/0150697 A1* 7/2005 Altman et al. ..... 178/19.02
2006/0197669 A1* 9/2006 Wu et al. ..... 340/572.7

FOREIGN PATENT DOCUMENTS

DE 29611937 11/1996

(Continued)

OTHER PUBLICATIONS

Japanese Office Action for Patent Application No. 2008-517380—dated Jan. 25, 2012 (in Japanese), pp. 1-4.

(Continued)

*Primary Examiner* — Masud Ahmed
(74) *Attorney, Agent, or Firm* — Gerald T. Bodner

(57) ABSTRACT

An assembly for electronically performing card games through data transmission between a game console and RFID elements, for reading out and/or changing game status or game course representing data and data characterizing player features. A game pad is provided with defined game fields for receiving data carriers whose information can be read out. An antenna coil device is embedded into the game pad, allowing the readout of game fields. At least one RFID-element is provided with autonomous power supply and a transmitter/receiver unit for data transfer to the console, and with optical and/or acoustic display elements. The RFID-element inductively enters into a data exchange connection with a coupling coil section of the antenna coil device so that the game card data carriers of the respective game field group are readable and possibly changeable, wherein furthermore a signaling element signalizes the reading of the game card data carriers.

20 Claims, 17 Drawing Sheets

FOREIGN PATENT DOCUMENTS

Figure 1:
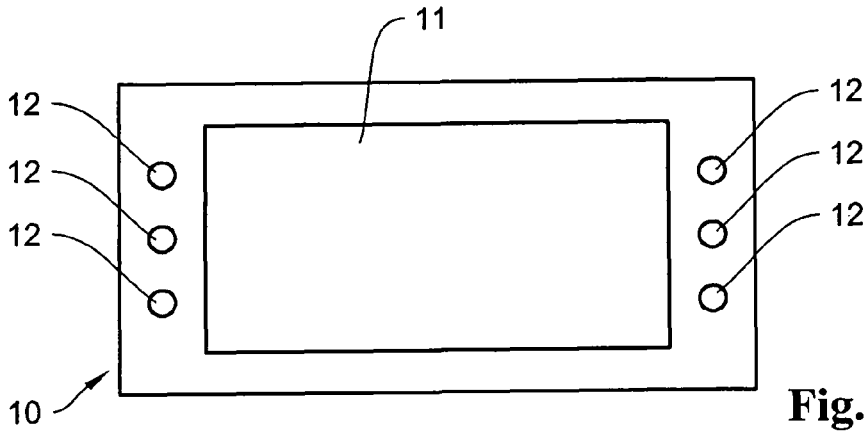

| | | |
|---|---|---|
| GB | 2344257 | 5/2000 |
| JP | H0535176 | 5/1993 |
| JP | 06285259 | 10/1994 |
| JP | 7275522 | 10/1995 |
| JP | H10503395 | 3/1998 |
| JP | 11238104 | 8/1999 |
| JP | 2001 170359 | 6/2001 |
| JP | 2002 202782 | 7/2002 |
| JP | 2002 530178 | 9/2002 |
| JP | 2004 505386 | 2/2004 |
| JP | 2004 193873 | 7/2004 |
| WO | WO96/03188 | 2/1996 |
| WO | WO 00/31676 | 6/2000 |
| WO | WO01/15059 | 3/2001 |
| WO | WO 02/10791 | 2/2002 |

OTHER PUBLICATIONS

English translation of Japanese Office Action for Patent Application No. 2008-517380—dated Jan. 25, 2012, pp. 1-4.

* cited by examiner

ARRANGEMENT FOR ELECTRONICALLY CARRYING OUT BOARD ROLE-PLAY AND CARD GAMES

The invention relates to an assembly for electronically performing board-, role-, or card collection games through data transmission from and to a game console, and RFID-elements for reading out and/or changing data, representing the score or the course of the game, and data, characterizing the properties of the players according to the preamble of patent claim 1.

Board games or also card collection- or role games are very popular.

So far, it was not possible without particular means to perform such games electronically, while maintaining the classic technique of the game, or to use an internet connection for transmitting game data or data regarding the course of a game.

Known game consoles comprise a display unit, or they can be coupled with a monitor, in order to display the course of a game, or the game itself. Such game consoles furthermore comprise input means, in order to guide a player through a game environment, and to initiate interactions of the player.

Classic games like e.g. a role game, resorting to character cards, cannot be combined with multimedia console games so far.

Based on the above, it is therefore the object of the invention to provide a device for electronically performing board-role- or card collection games through remote data transmission from and to a game console and RFID-elements for reading out and/or changing data, which represent the score or the course of the game, and data, characterizing the features of the players, wherein the layout of the classical course of the game shall not be impeded, and wherein the required data transmission is particularly simple and can be realized without influencing the course of the game.

The object of the invention is accomplished through an assembly for electronically performing board-, role-, or collection card games, according to the feature combination according to patent claim 1, wherein the dependent claims constitute at least useful embodiments and refinements.

According to the invention, initially a game pad with defined game fields is provided, wherein the game fields are used for receiving data carriers, like e.g. game cards or game figures, whose information can be read out electronically.

An antenna coil device is embedded into the game pad, which allows reading out a plurality of game fields from a predetermined location in the vicinity of a game field group.

Furthermore, an RFID-element in the game pad and/or a local console with autonomous power supply, which can be placed onto the game pad, and a transmitter-/receiver unit for data transmission to the superimposed game console or a similar device are elements of the assembly according to the invention.

The local console furthermore comprises simple optical and/or acoustic display elements, e.g. in the form of light emitting diodes and/or acoustic signal generators. The local console enters into a data exchange connection inductively with a coupling coil area of the antenna coil device of the game pad through placing or positioning thereon.

In this data exchange connection, the data carriers integrated into the game cards or game figures of the respective game field group become readable. Also, there is the possibility to change the information disposed on the game card data carriers in a targeted manner.

In a useful manner, signaling means for a read-/write event of the game cards, or game figure data carriers are provided.

In a preferred embodiment, the game pad is made of a flexible material, which is resistant against environmental impacts, and which has an imprint for receiving and placing of the at least one RFID-element with a housing.

The local console for receiving the RFID-element preferably has a cylindrical, or a square housing, wherein the housing length substantially corresponds to the width of the game pad, or the impression therein, so that the game pad can be wrapped around the housing for transportation purposes.

Like the game pad being comprised of a resistant material, the local console is protected against water spray and it is thus provided resistant against environmental impacts.

The transmitter/receiver unit included in the local console establishes the data transfer to the superimposed game console in a wireless manner, and thus over preferably standardized interfaces, e.g. a so-called Bluetooth connection.

In another embodiment, the game console is provided as a game board, which can be coupled with additional game pads for forming a game field of any size. The game pad is thus used as an element of an expandable kit system, through which game fields of any size can be created through simple coupling.

As a supplement to the above mentioned features the local console has an internally programmable data processing device for performing a game on the game pad coupled with the local console. Thus, respective games can be played on the game pad in a completely autonomous manner, and their scores can later be called up and can be stored in other devices.

A skin housing and/or a placeable game board skin, which can be placed onto the local console and/or the game pad, are particularly useful in this context. Thereby, the local console or the game board can be used for several games of any variety, wherein the meaning of the particular fields or key elements are shown to the players in a simple manner.

In a particularly advantageous embodiment, the skin housing comprises one or several skin keys in mechanical contact with key elements on the local console. The players thereby operate the keys assigned to a unique game context on the skin housing and thus initiate the respective key pressure on the local console, wherein said key pressure initiates the respective procedures in the internal game program.

The information stored on the data carriers in the game cards or game figures is encrypted in a useful manner, and the data carriers comprise an unique, non-changeable data carrier identification, in particular a serial number. Falsifications and manipulations of the data carriers and of the information included thereon are thus avoided, or at least made more difficult.

In an advantageous embodiment, the local console comprises sensors, in particular for bright/dark state and/or biometric fingerprint recognition. Bright/dark states in the room can thus be incorporated into the action of the game. Furthermore, a very simple and safe authentication and registering of all participating players is possible through the biometric sensors.

The local console can furthermore also comprise a device for generating acoustic signals, in particular language and/or sound signals and/or a speech recognition device. With these functions an enrichment of the game action, or a simplified operation is accomplished.

The game cards and/or the game figures in a useful embodiment include transponder devices with individually provided inductivities, which can be differentiated by the antenna coil devices in the game pad. These inductivities are a feature, which is simple to detect, and which cannot be falsified, wherein an additional storage device in the game card, or in the game figure can be dispensed with. The identification of the card or the figure is performed in a simple manner through the response of the transponder loop, disposed within the card or the figure, in particular through the reverse effect of the magnetic field of the current flow induced in the transponder loop.

The invention will be described in more detail subsequently based on an embodiment. Subsequently, the housing provided with the RFID-element is designated as fight deck and the game pad is designated as fight pad. The FIGS. 1 through 21 are used for illustration purposes. Like numerals are used for like elements or for elements operating the same way.

Figure 2:
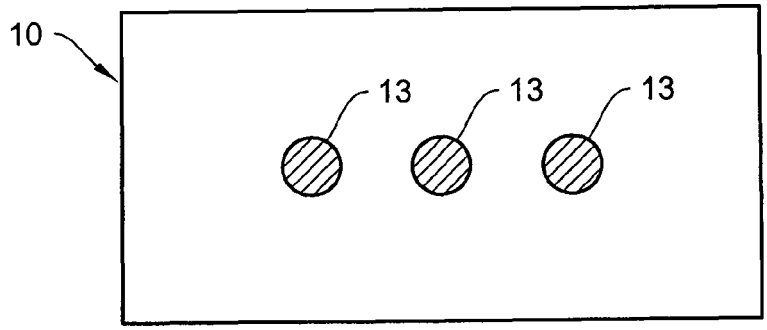
Figure 3:
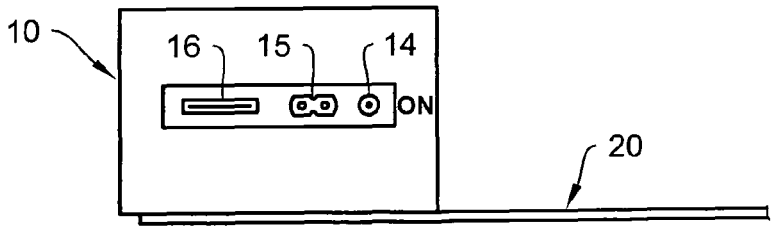
Figure 4:
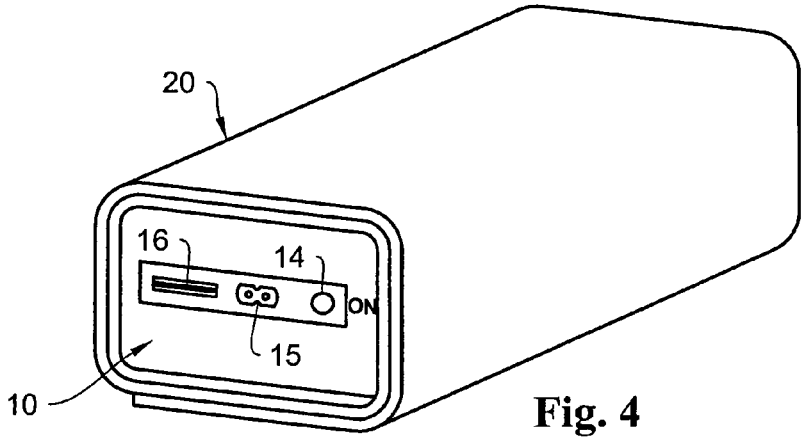
Figure 5:
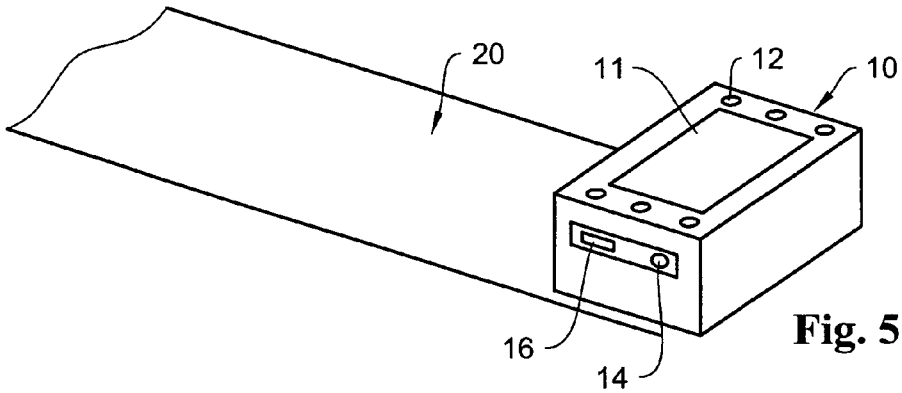
Figure 6:
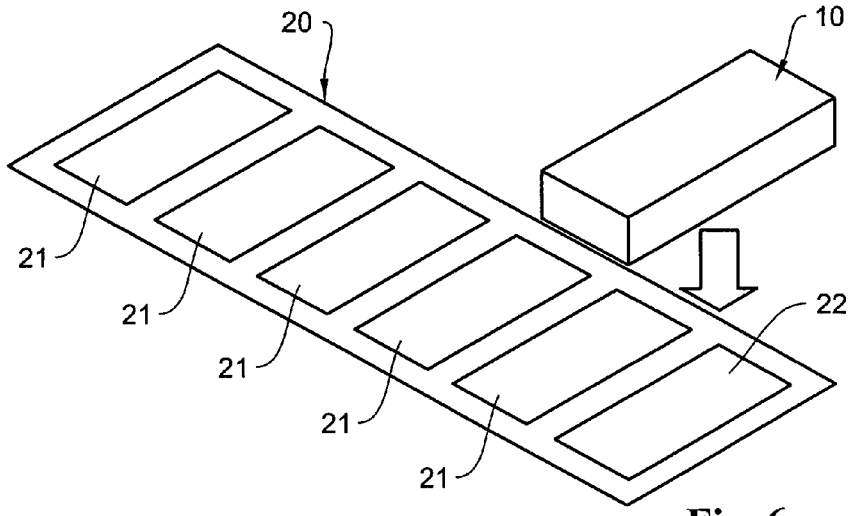
Figure 7:
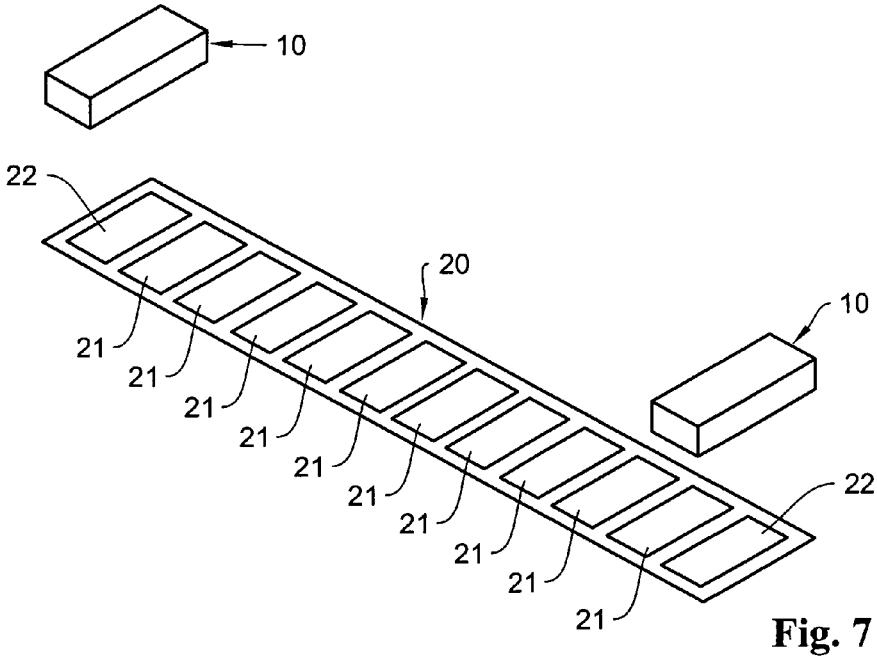
Figure 8:
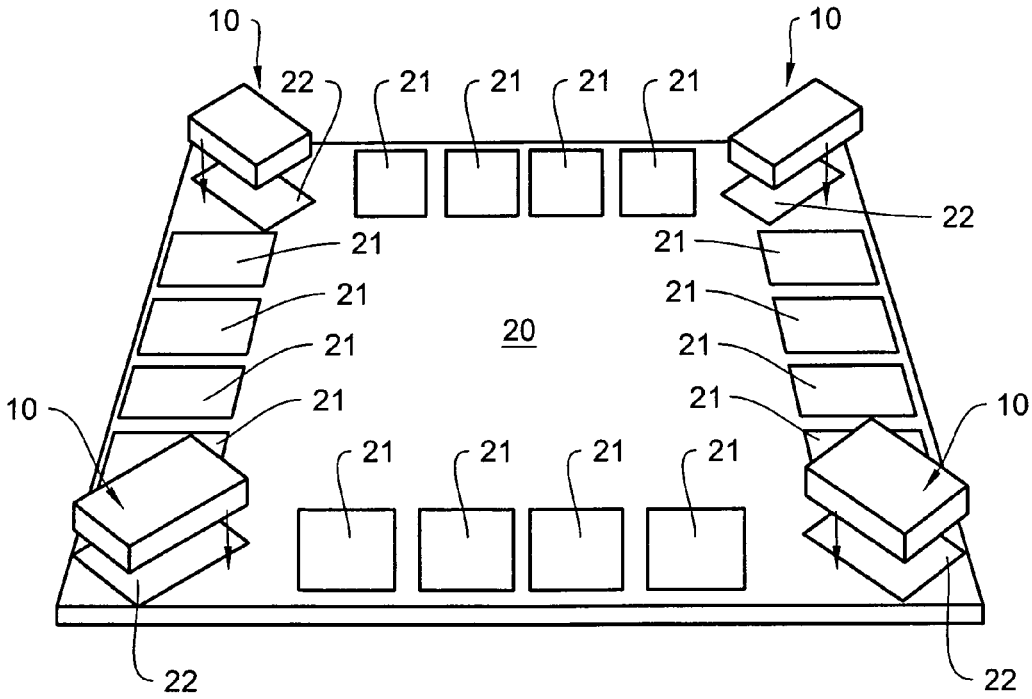
Figure 9:
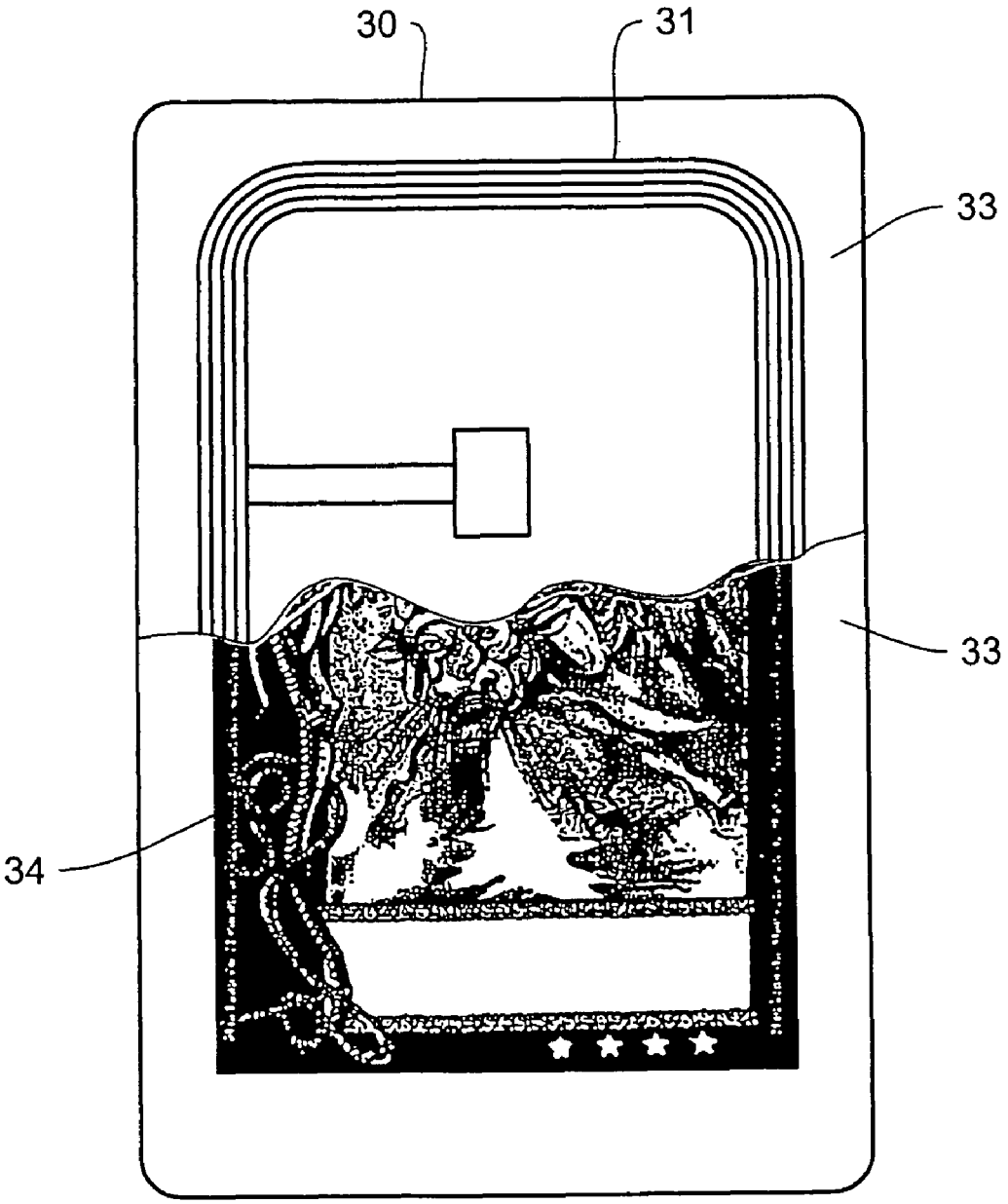
Figure 10:
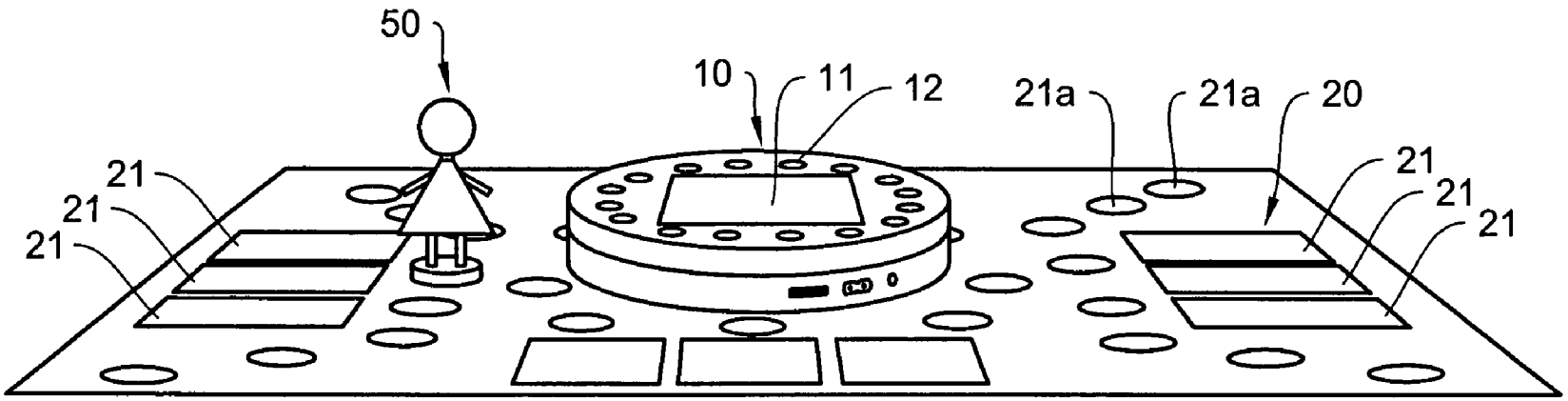
Figure 11:
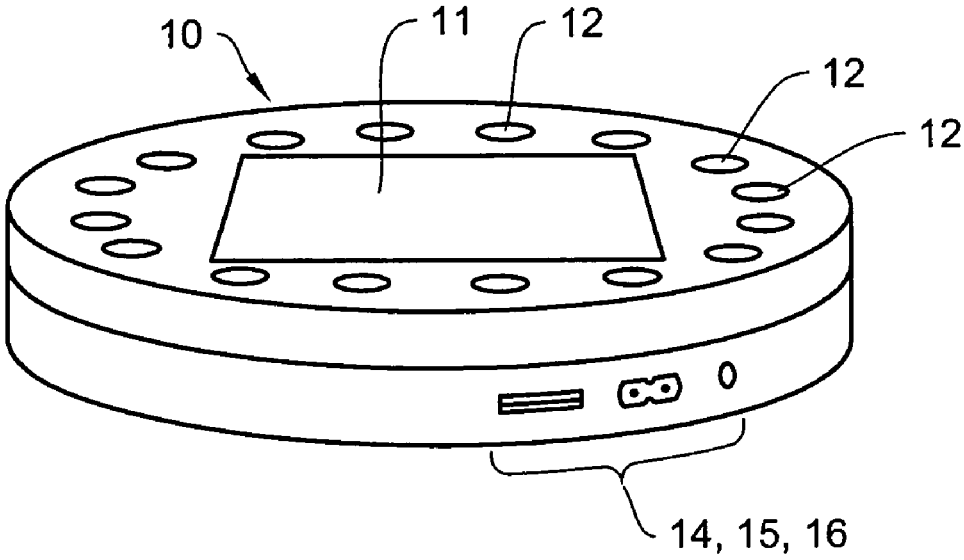
Figure 12:
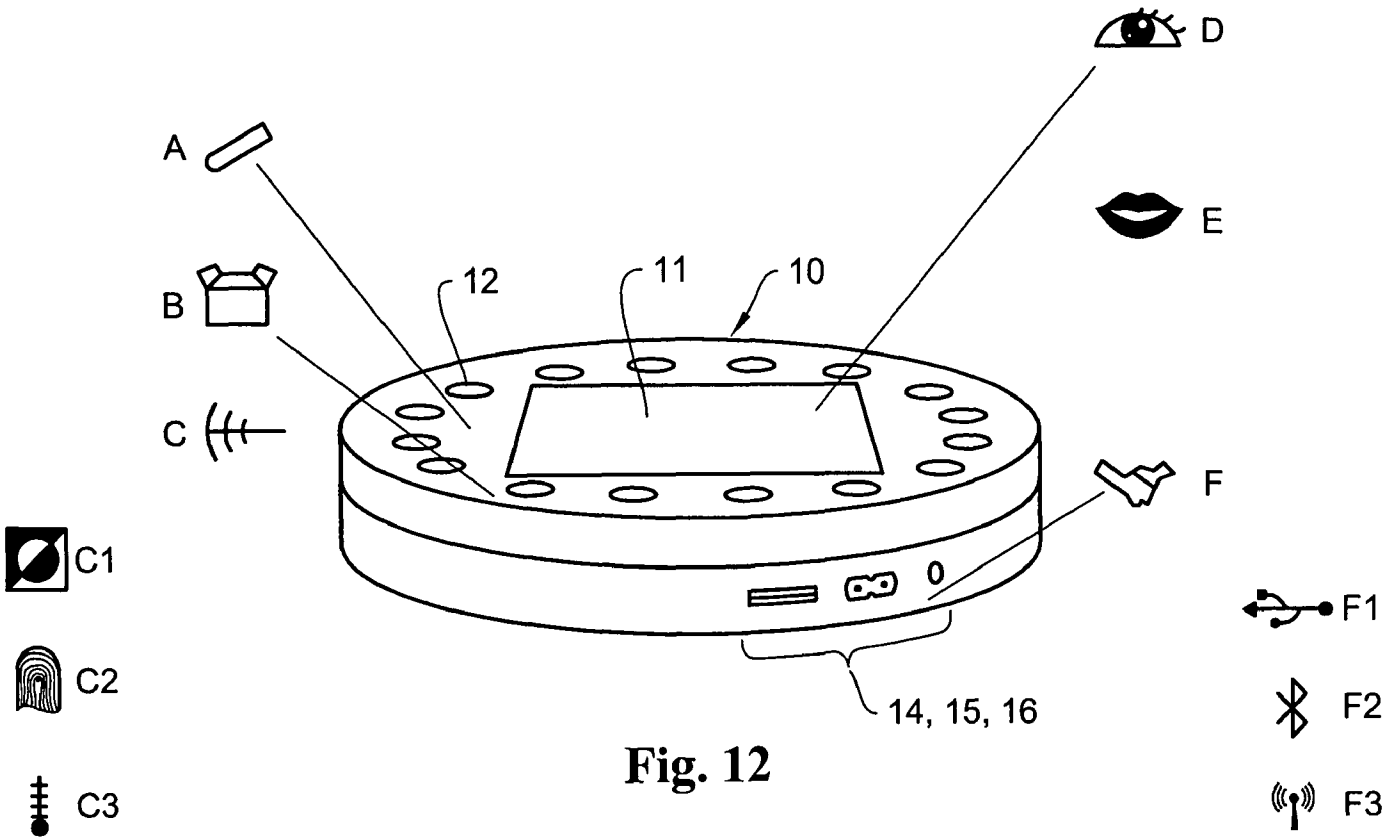
Figure 13:
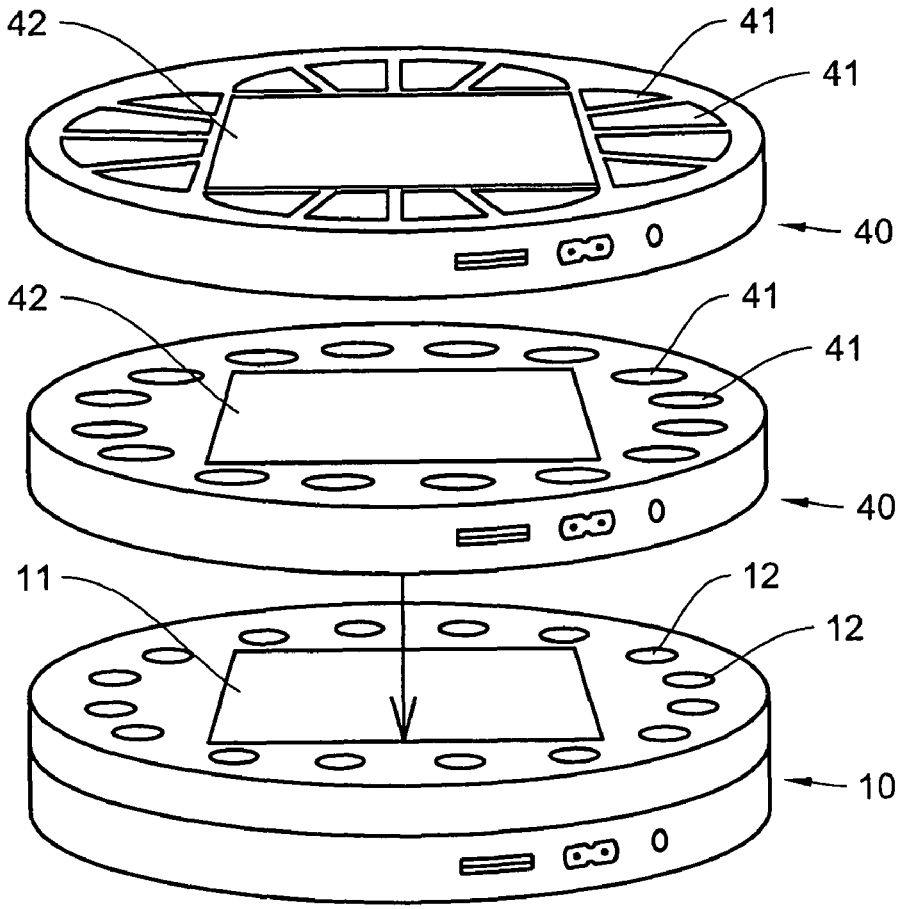
Figure 14:
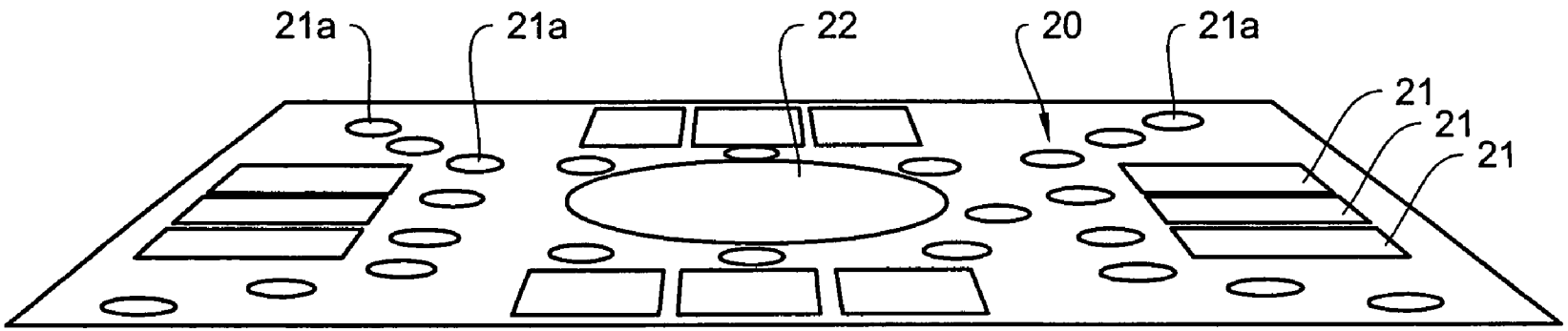
Figure 15:
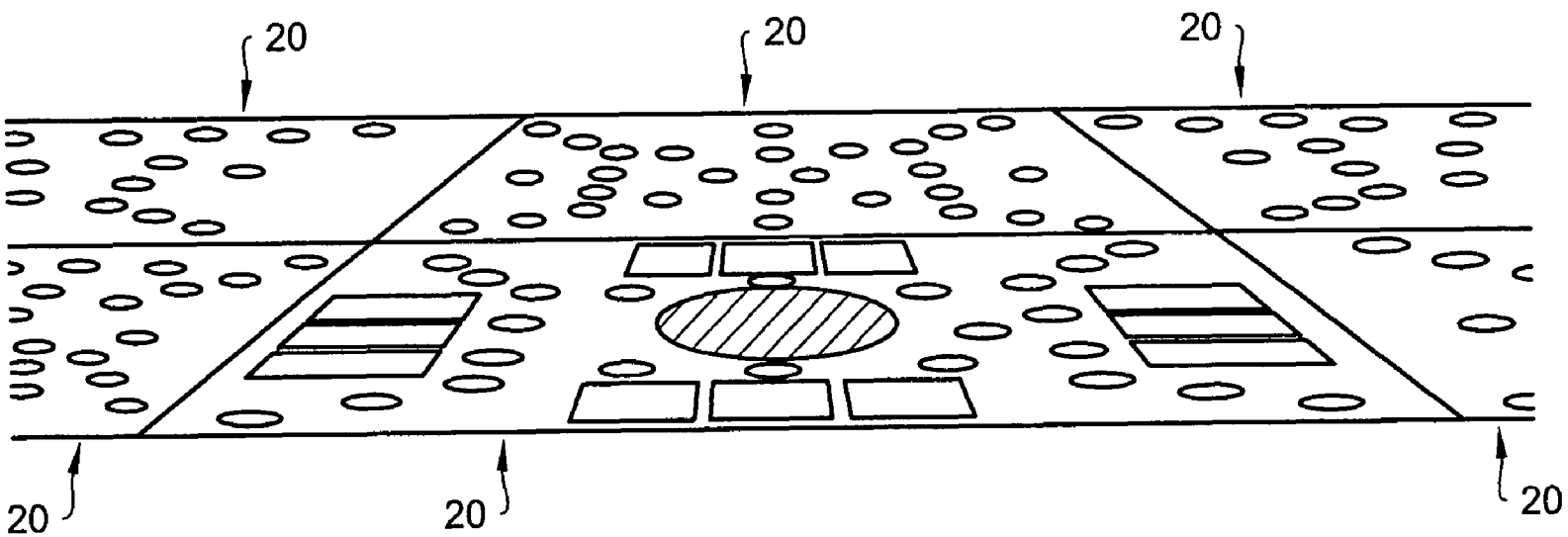
Figure 16:
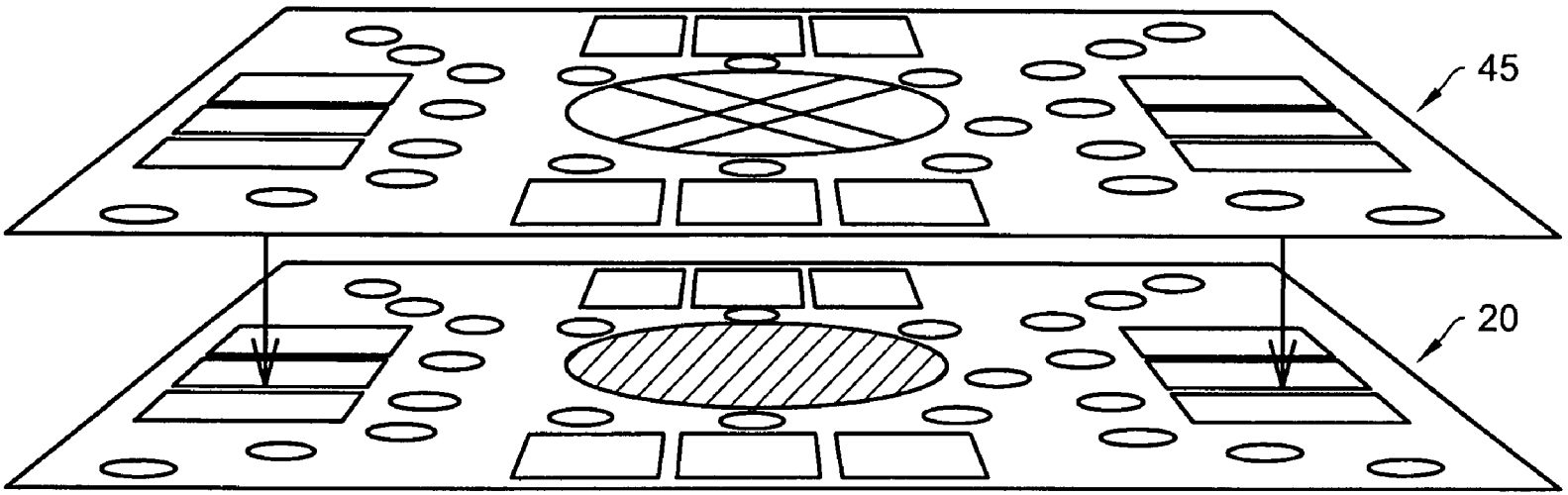
Figure 17:
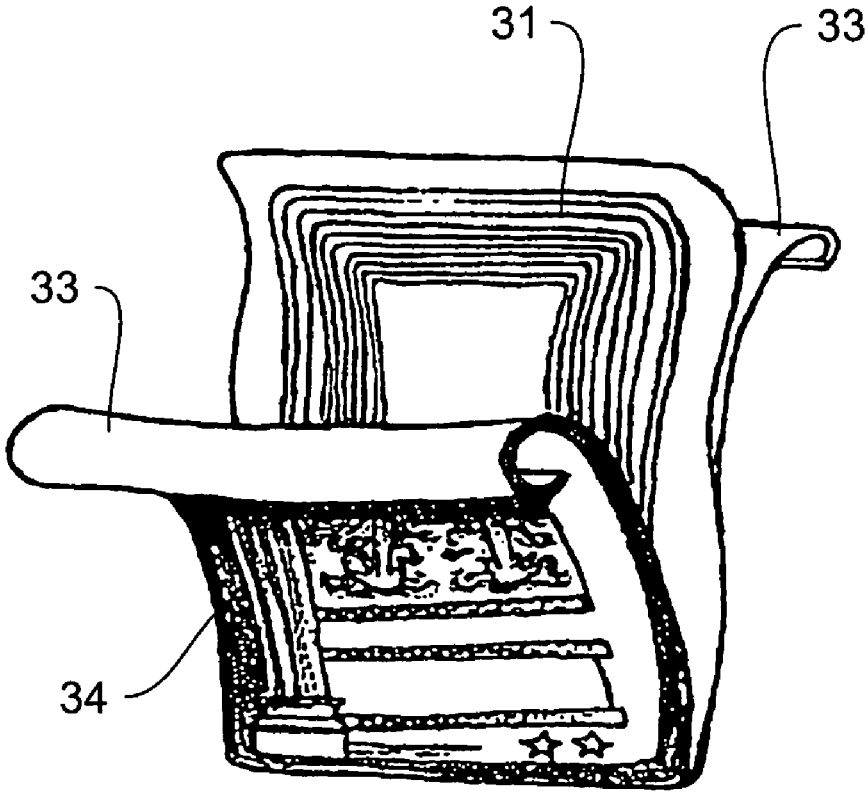
Figure 18:
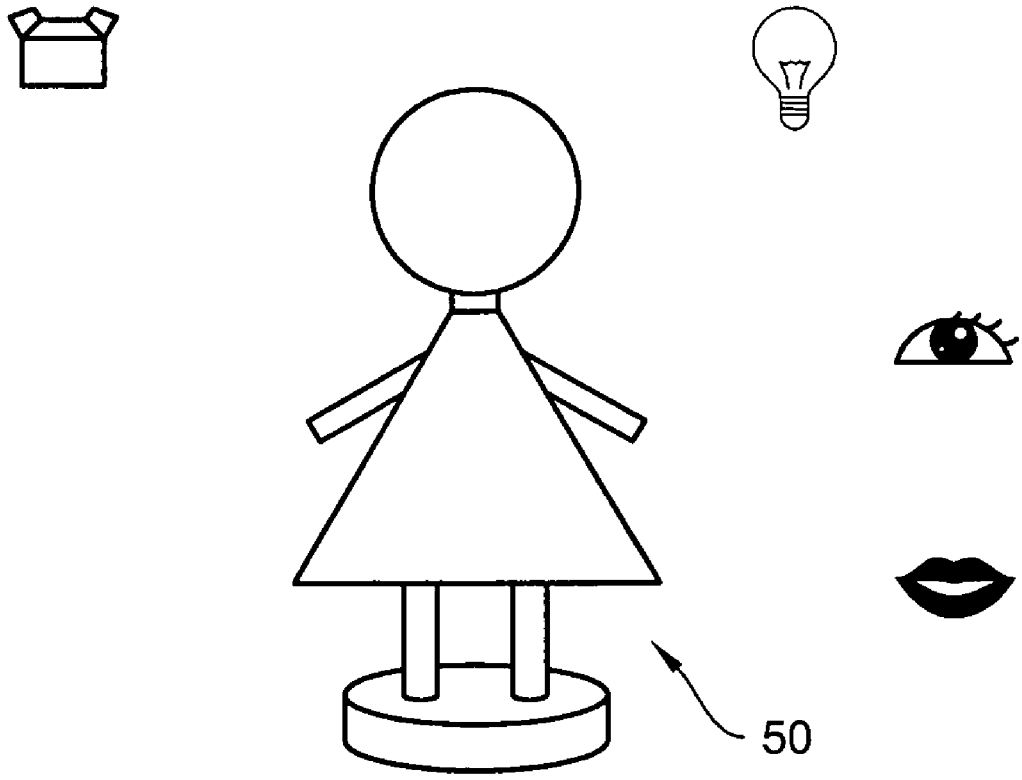
Figure 19:
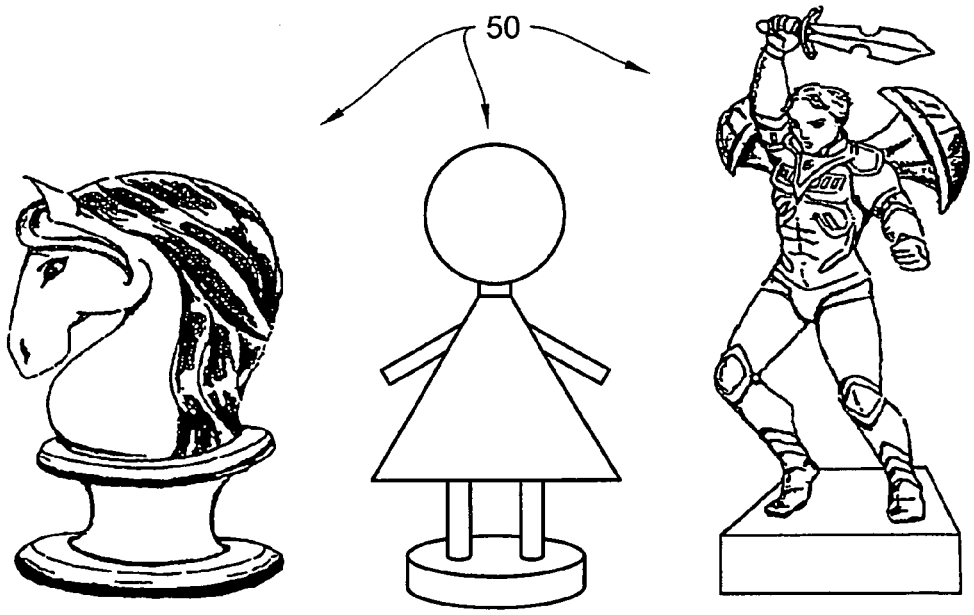
Figure 20:
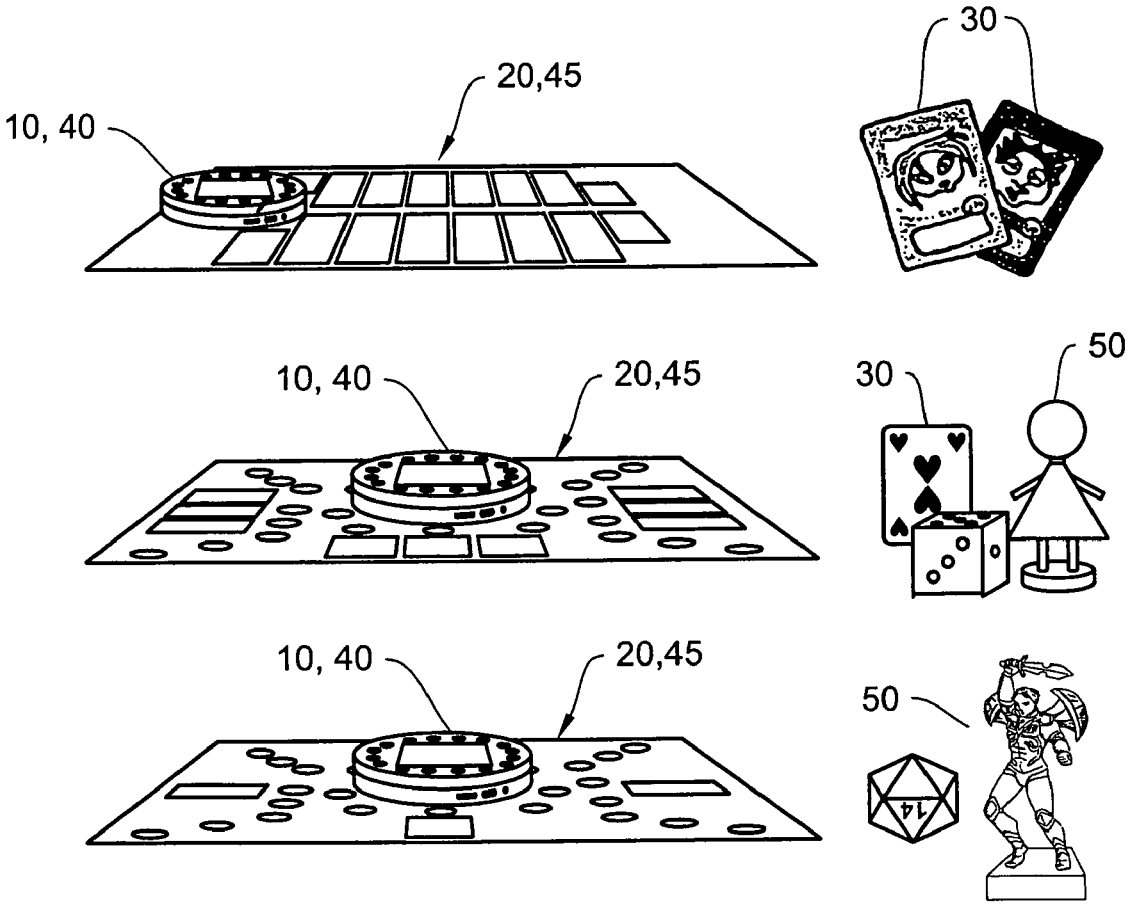
Figure 21:
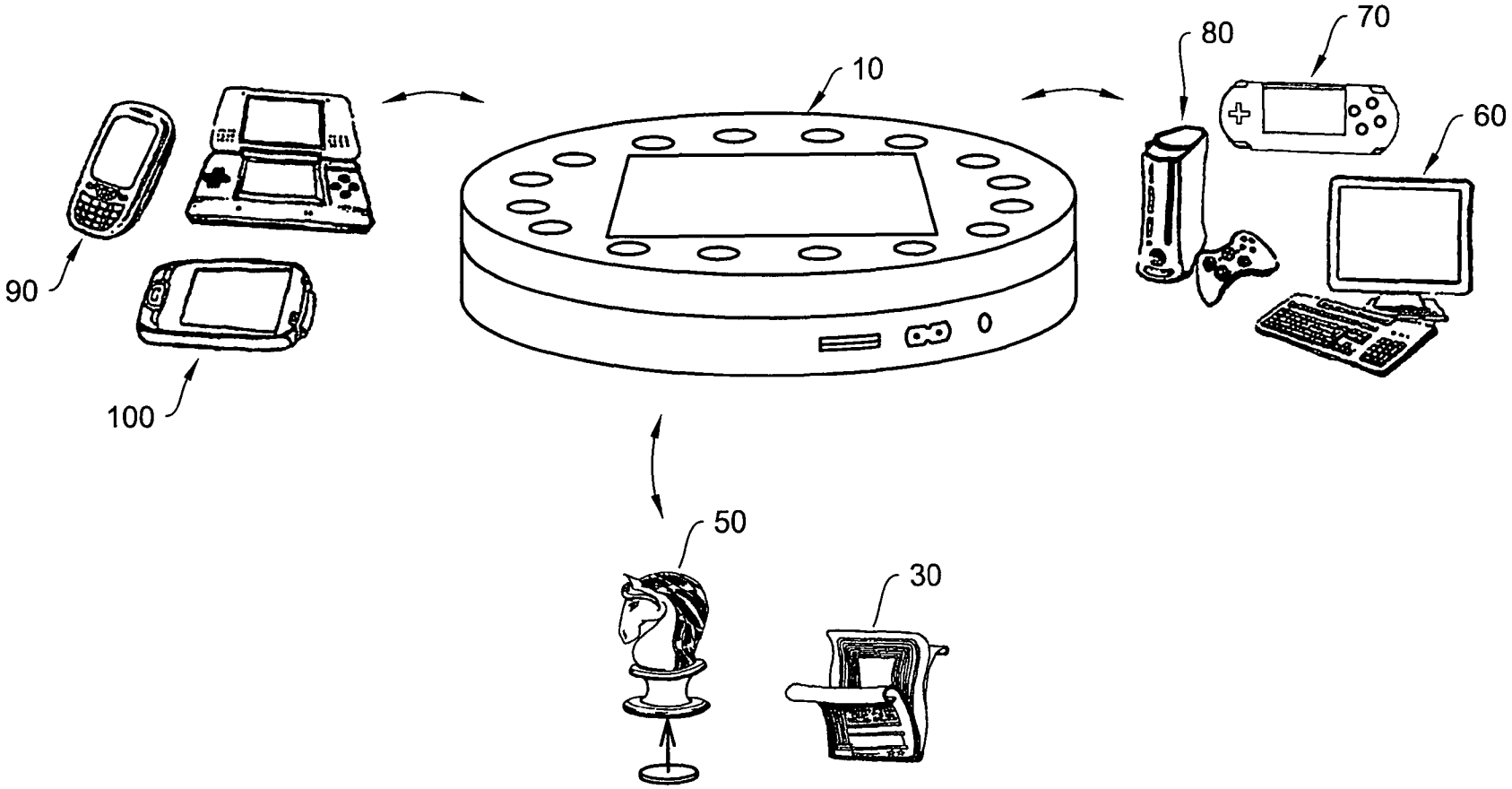

It is shown in:

FIG. 1 an exemplary fight deck in a top view;

FIG. 2 an exemplary fight deck in a bottom-up view;

FIG. 3 an exemplary fight deck in a side view with a section of a fight pad;

FIG. 4 a fight deck rolled into a fight pad;

FIG. 5 fight deck and fight pad in an unfurled state;

FIG. 6 a fight pad with a superimposed fight deck;

FIG. 7 a fight pad with two superimposed fight decks;

FIG. 8 a fight pad provided as a square mirror surface for four players with four superimposed fight decks;

FIG. 9 a game card designated as an Autron with an inner antenna coil device and a chip;

FIG. 10 another embodiment of a game surface with a fight deck for game pieces and game cards;

FIG. 11 the fight deck shown in FIG. 10 in a single view;

FIG. 12 an illustration of exemplary functionalities of the fight deck from FIG. 11;

FIG. 13 exemplary skin adaptations for the fight deck shown in FIGS. 11 and 12;

FIG. 14 the game surface of FIG. 10 in a single view;

FIG. 15 the game surface of FIG. 14, coupled with additional game surfaces;

FIG. 16 an exemplary skin adaptation for the game surface of FIG. 14;

FIG. 17 an exemplary game card;

FIG. 18 an exemplary game piece with exemplary functionalities;

FIG. 19 various exemplary forms of game pieces;

FIG. 20 an illustrating depiction of various game possibilities through adapting the fight deck according to FIGS. 10 and 13 and of the game surface according to FIGS. 14 and 16;

FIG. 21 various terminal units, which can be coupled to the fight deck of FIG. 10 and data storage devices.

FIG. 1 shows an exemplary fight deck 10, serving as a local console for performing the games, in particular for the interaction of the players, their game figures, or game cards, and for score recording in a view from the top. The fight deck has key input and display elements, in order to be able to call up or to control basic actions within the course of the game, or to be able to call up or control certain functions of the fight deck.

The illustrated exemplary fight deck has a display 11 and a row of keys 12. The display displays the basic moves of the game and the game events, and scores and game results in a graphic manner. It is provided e.g. as a monochrome or colored LCD graphic display with a resolution 128×64 pixels.

On the fight deck display elements in the form of light emitting diodes, either in combination with the display, or instead of the display, can be disposed, which display actions performed. Furthermore, additional acoustic signal generators can be disposed in the fight deck, and can signal particular game events or functional actions in a suitable manner, e.g. through outputting a signal tone or a signal melody. In particular, the light emitting diodes can perform an existing communicative connection of the fight deck with an external unit, a readout of an Autron, this means of a game card put on the fight pad, and the display of an operational readiness of the fight deck or fight pad.

The operation of the fight deck is performed through the keys 12 and indirectly through the Autrons described further below, or at least one connected fight pad.

The fight deck is portable and can be carried through its suitable dimensions and a sufficiently low mass comfortably in the typical pockets in garments or small pieces of luggage. Through an internal accumulator or a battery, it can be used at any location without a permanent electric power supply. Charging the accumulator is performed with a commercially available charger, or through an external power supply of the fight deck, which can be connected.

The bottom side of the fight deck shown in FIG. 2 has a number of Velcro or glue surfaces 13, which are used for a safe mounting of the fight deck on the fight pad described further below. Optionally, at least one of the Velcro or glue surfaces 13 can be provided electrically conductive for a signal transmission between fight deck and fight pad. In a useful manner, the Velcro, or glue surfaces 13 are provided disengageable, wherein the fight deck and the fight pad can be connected or disengaged with or from each other any number of times.

FIG. 3 shows an exemplary side view of the fight deck. For turning the fight deck on and off, a keying switch 14 is provided in this embodiment. A socket 15 serves as a connection of a cable for charging the internal accumulator.

Through the use of standardized interfaces, a particularly flexible and universal use of the fight deck is possible. For a readout and infeed of data, the fight deck is provided with at least one interface for data exchange with an internal unit, e.g. a computer, a notebook, a superimposed game console, or functionally comparable units. In the illustrated embodiment, a USB connection 16 is provided as an interface, which can also serve as a voltage supply. However, also other interface types can be integrated into the fight deck. In particular, also a wirelessly operated Bluetooth interface can be realized. Particular driver programs can be installed within the fight deck, or within the respective external unit, performing the communication and an exchange of certain functionalities between the fight deck and external units. Thus, it is e.g. possible to update program data, or to feed them in anew. Through the interface, it is possible in particular to copy new program versions, card data, or similar into the fight deck.

In FIG. 3 the fight deck is disposed on a fight pad 20 in a useful manner. The fight deck is suitable for outdoor use, and has a sufficiently good resistance against strong sun radiation, moisture, and summer and winter temperatures in the range of −20° C. up to +65° C. The housing of the fight deck is made from plastic in a useful manner.

The fight deck does not have to comprise all described features, and can thus satisfy different comfort requirements. One or several fight decks can thus be in connection with a superimposed game console, wherein the data exchange is preferably performed through a wireless Bluetooth connection. A respective transmitter/receiver device is provided in the fight deck.

The FIGS. 4 and 5 show an exemplary fight deck 10 with a game pad subsequently designated as fight pad 20. In FIG. 4, the fight deck is wrapped into the fight pad, FIG. 5 shows an unfurled state of the fight deck and fight pad.

The game field pad, designated as fight pad e.g. comprises four game fields, for playing out Autrons. Certainly, there is the possibility to expand the game field at will.

The previously described fight deck is fixated through the above mentioned Velcro, or glue connections on the fight pad, and performs a data exchange with the fight pad, either through an electric contact, or preferably through a contactless RFID-element. Depending on the size and layout of the fight pad, also two or more than two fight decks can be connected to a fight pad. A connection with contacts is also possible between fight deck and fight pad, and can be realized in less expensive embodiments.

FIG. 6 shows a fight pad 20 with a fight deck 10, which is fixated on a coupling surface 22 with an RFID-element, disposed within the fight pad. FIG. 7 shows a fight pad 10 in an embodiment for mounting two fight decks 20 at two coupling surfaces 22. FIG. 8 eventually shows a fight pad 20 for placement of four fight decks 10 with a respective number of coupling surfaces 22. Such a fight pad is thus useable for a multiplayer operation.

The RFID-elements in the coupling surfaces are provided in the form of a coupling coil assembly.

The fight pad comprises a number of game fields 21, whose number and arrangement can be selected at will in principle. In the area of the game fields 21, additional RFID-elements are inserted, which read out, or write data from/to the game cards placed thereon, the so-called Autrons. Each of the RFID-elements in the game fields 21 is connected with the RFID-element in the coupling surface 22 of the fight pad. Thus, each deposited Autron can be registered, or tracked on the game fields 21 of the fight pad 20 through the fight deck 10.

The fight pad is made of a flexible material, e.g. a textile woven material, or a plastic foil with a laminated antenna coil device. Thereby, it is possible as discussed to wrap a fight pad around the body of the respective fight deck. The material of the fight pad is sufficiently robust, waterproof in a useful manner, and can be wiped down, temperature resistant in the range between 20 and 65° C., and thus also suitable for outdoor use.

In one embodiment, the fight pads have an area with Velcro band, or a gluing location, on their backside, which works together with the respective Velcro or glue locations 13 at the fight deck, and which is used for fixating the fight pad at the fight deck.

In a suitable embodiment, the upper side of the fight pads has an imprint, or a particular designation at the respective areas, this means in the area of the coupling surfaces 22, e.g. a particular coloration for placing the respective fight deck.

The fight deck 10 and the fight pad 20 allow performing games and are used here, in particular for the interaction of game figures or cards.

For performing the game, the fight deck can be connected through a standard interface with the superposed game console. Thus, the game console centrally monitors the game events evolving on the fight pad. It is also possible, however, to place at least one fight deck onto a fight pad and to play quasi offline, wherein the game conditions thus accomplished, and the results can later be transferred to an external unit. Data, which are read out can be displayed, processed and changed on the console, or depending on the embodiment, also on the display 11 of the fight deck. The data, thus modified, are transferred back to the Autrons, or game figures, through the fight deck.

FIG. 9 shows an exemplary game card with a data carrier integrated therein, provided as an Autron 30. Thus, this is an autonomous storage unit for storing basic rules and game figures, active in the game, or game statuses, which need to be considered in a role game, or in a card game and which interact with each other. The information stored in the Autrons is read out, or put in through the fight pad and are being changed through the fight pad as described.

The Autrons are provided as a chip card with paper or plastic as carrier material. They include a transponder 31 or an RFID-chip 32, connected with the transponder, which stores basic data and information and which exchanges data with the fight deck through the fight pad in a contactless manner. The Autrons include in a suitable manner the energy supply necessary from an electromagnetic high-frequency field generated by the fight pad or the fight deck. The transponder is laminated between two cover surfaces 33. The transponder can be provided with respect to its inductivity, so that it refers to the card in a unique manner and so that it is a feature identifying the card. The antenna coil device in the fight pad detects the respectively present inductivity in the form of the inductive reverse effect of the power flow within the transponder and registers or processes it in the fight deck accordingly. The individual inductivity follows e.g. from a respective number of windings of the transponder within the card.

The locations of the card can thereby be tracked on the fight pad. The card does not have to comprise a RFID-chip, if this one feature suffices for unique identification. Accordingly, the card can be provided in an economical manner.

At least one of the two card cover surfaces has a decoration 34, which is typical for game cards, which identifies the Autron to the player as a game card with certain game properties. For this purpose, in particular hot impressing techniques or the insertion holograms can be used.

The RFID-chip 32 can perform an authentication procedure in connection with the fight deck 10, avoiding, that falsified or illegally duplicated Autrons are used in the game.

In a suitable manner, also the Autrons are suitable for outdoor use and also have a temperature resistance in the range of −25° to 65° C.

FIG. 10 shows another exemplary embodiment of a fight deck 10 and a fight pad 20. The fight deck in this example comprises a round, in particular circular, base shape. The fight pad 20 is substantially square and has additional placement fields 21*a* besides the playing 21 fields described above. The placement fields are used for placing and pulling at least one game figure 50 and for a signal transfer between game figure and fight pad or fight deck. For this purpose, also a contactless signal transmission between a storage unit in the game figure and a transponder device in the placement field 21*a* is resorted to. The fight deck 10 and the fight pad 20 of FIG. 10 perform a signal transfer as described above through the coupling surface, which is covered up in this illustration. The fight pad shown in the figure can also be provided so it can be rolled up or folded, or it can be provided as a rigid game board of plastic or another compound material for a board game.

As shown in FIG. 11, the fight deck has a display 11 also in this embodiment and a row of keys 12. An On/Off key shifter, power supply sockets, and certain connections 14, 15 and 16 are also present. In combination with the fight pad of FIG. 10, the fight deck in this embodiment includes additional internal program routines for processing signals from the game figures 50, moved on the placement fields 21*a*. The fight deck is configured in combination with the fight pad, in particular the game board of FIG. 10 for performing a board game, and can be configured with respective software. Depending on the design of the game board, the typical board games like for example the well known "Mensch ärgere dich nicht", "Halma", and similar games, but also typical card collecting games, or also combinations of board game and card collection game can be performed as a hybrid board- and computer game.

For this purpose, the fight deck 10 of FIG. 11 is provided with a number of functionalities, which are described in FIG. 12. The keys 12 can be provided as illuminated keys A. The storage disposed within the fight deck has an expansion capability B. For operating the keys 12, additionally a sensor assembly C can be resorted to. Thus, in particular a day/night or bright/dark sensor array C1 is possible, in which certain real times of the day, or artificially induced bright/dark conditions in the room can flow into the course of the game. But also biometric sensor arrays C2, in particular fingerprint recognitions can be integrated into the keys 12, wherein such sensor arrays allow a very simple authentication of minor players without any knowledge of reading or writing. Eventually also a temperature sensor array C3 is possible, which detects certain external temperature conditions, and which transfers them into the game event depending on requirements.

The display 11 can be provided for a color, or black and white display D. Furthermore, also a language output, or a language module can be integrated into the fight deck, which performs sound or voice outputs, e.g. based on a WAV or MP3 file format. Speech recognition is also possible.

Certainly, also fight decks can be realized, allowing a purely acoustic signal output without optical display elements. Such embodiments can be realized for particularly economical solutions.

The interfaces 14, 15, and 16 can be provided as USB interface F1, Bluetooth interface F2, and/or WLAN-interface F3. The fight deck can thus be configured in a very simple manner through an external computer, in particular reconfigured through software.

The change possibilities of the fight deck shown in FIG. 13 using a skin system are particularly advantageous with respect to the game comfort. The keys 12 of the fight deck are associated with different meanings, depending on the respective game program running on the fight deck, and initiate different actions. In order to indicate this to the participating players, housing tops covering the fightdeck, so-called skins 40 are placed onto the fight deck, whose color design and symbolics correspond to the game presently performed.

The skins comprise a number of skin key shifters 41, which are in mechanical contact on the superposed skin with the keys 12 on the fight deck and which emphasize the respective initiated action to the players through their color, shape, and symbolics. The skins can be replaced without any problem. In the area of the display 11 a skin display 42 is provided, which is provided as a simple cutout in the simplest case, which opens the view upon the display 11, disposed there under. The skin display can also be provided as a transparent window, which has decorations relating to the game events, or which comprises other design features.

The game board of FIG. 10 is shown in FIG. 14 in a single illustration. As indicated, the game board includes a number of game surfaces 21 for cards, placement fields 21*a* for game figures, and a coupling surface 22 for the fight deck. Game cards and game figures can be exactly localized and also influenced as described. Furthermore, the game board of FIG. 14 can also be expanded.

Additionally, it can comprise devices for a topology recognition, which can be used for so-called "table-top role games". Furthermore, also light elements and switches can be disposed on the game board, which react either directly to drawn or otherwise moved game figures or cards, or which are activated through the fight deck. For this purpose the game board can be provided with connections into which illumination elements or additional modules can be inserted.

FIG. 15 shows an additional expansion possibility. Several game boards or fight pads 20 are assembled in this example, and form a larger playing surface according to a kit principle. Thus, the particular game boards are assembled with each other at the edges through contact locations and perform a signal exchange. Thus, a fight deck on one of the game boards can also comprise game figures and game statuses on the neighboring game boards. This is performed through a game board recognition in which the game software present within the fight deck calls up certain identification signals from the associated game boards and processes them.

Another possibility for game board expansion are game board skins. FIG. 16 shows an example with reference to this. The game board, or the fight pad 20 in the lower part of the figure thus form a base shape, while the fight pad skin 45 is placed onto the base shape, and constitutes a new "game landscape" through its particular design. The interaction of the fight pad skin of the skin for the fight deck described above and the game software, which is variably loadable into the fight deck, thus realizes performing a number of different games with a predetermined base configuration.

FIG. 17 shows an exemplary game card with its construction from a transponder 31, cover surfaces 33, and decoration 34. The game cards, and thus also the game figures, the fight pads, game boards and fight decks can also comprise a designation in the form of an electronically readable or otherwise detectable serial number, which prevents unauthorized copying of the card. The serial number and also the data stored on the card can be cryptographically encoded. It is appreciated that the game conditions stored in the game card (or the game piece, the fight deck, or also the fight pad or the game board), stored game statuses, data and other information is also maintained after the end of the game.

As a matter of principle also a direct communication between particular cards and game figures, or also directly between fight deck and game figure or card in circumvention of the fight pad, or also to other reading devices, can be performed.

FIG. 18 shows an exemplary game figure 50 with a number of exemplary functionalities. The game figure, similar to a game card, comprises in its body storage elements and devices for contactless signal transmission, in particular a transponder. Additionally, illumination elements, in particular LEDs, simple displays, e.g. small LC displays, with simplified variable facial features, or seven segment displays for numbers, or also language modules for putting out language or tones can be integrated into the game figure.

The transponder devices, as already described within the game figure can have an individual inductivity, which can be recognized by the antenna coil devices in the fight pad. Thereby, the game figure is characterized by a unique, physically easily detectable feature, in the course of the game.

Certainly the game figures in their outer shape can correspond to the provided game. FIG. 19 shows a few examples for this.

FIG. 20 shows an overview of exemplary embodiments for fight deck, fight pad, and game cards, or game figures for a card collection game (above), a family game (in the middle) and a role game (below), wherein at least the embodiments for the family and the role game obviously are based on the same basic form of game board and fight deck, and are adapted through the above mentioned skin to the respective game.

FIG. 21 shows an overview of the objects and devices, with which the fight deck can communicate. These can be personal computers and notebooks 60, handheld game consoles 70, stationary game consoles 80, mobile telephones 90, organizers 100. As described, the fight deck also performs communications with the game cards 30 and the game pieces 50.

Further embodiments result from useful designs, performed by a person skilled in the art, in particular based on the dependent claims.

DESIGNATIONS

10 fight deck
11 display
12 key
13 Velcro or glue surface
14 On/Off key shifter
15 power supply socket
16 USB connection
20 fight pad
21 game field
21*a* placement field
22 coupling field
30 Autron
31 transponder
32 RFID-chip
33 cover surfaces
34 decoration
40 fight deck skin
41 skin key shifter
42 skin display
45 fight pad skin
50 game FIG.
60 PC, notebook
70 handheld game console
80 stationary game console
90 mobile telephone
100 organizer

What is claimed is:

1. An assembly for electronically performing at least one of board, role and collection card games, comprising means for at least one of reading out and changing data representing one of a game status and a game course and data characterizing player properties, comprising a game pad (20) with defined game fields (21) for the purpose of receiving data carriers integrated in at least one of game cards (30) and in game figures (50), whose information can be read out, wherein an antenna coil device is one of embedded and inserted into the game pad, allowing the readout of a plurality of game fields from a predetermined location in the vicinity of a game field group, characterized by at least one RFID element in at least one of the game pad and in a local console (10) which local console can be placed onto the game pad for performing games and for score recording, wherein said local console comprises an autonomous power supply and a transmitter/receiver unit in the form of at least one interface for reading out and importing data and for data transfer to at least one of a superimposed game console, a computer, a notebook, and functionally comparable devices, and comprising at least one of optical and acoustic display elements (11), wherein the RFID element enters into a data exchange connection with a coupling coil section of the antenna coil device of one of the game pad and the local console through placement or superposition thereon, so that the data carriers integrated into at least one of the game cards and game figures of the respective game field group are readable and possibly changeable, wherein a signalizing means is provided for a read/write process of the game card or game figure data carriers, wherein the local console can be fixed onto the game pad and performs a data exchange with the game pad.

2. An assembly according to claim 1, wherein the game pad (20) is comprised of a flexible material, which is resistant against environmental impacts and which comprises an imprint for receiving and depositing the at least one RFID-element including a housing.

3. An assembly according to claim 1, wherein the local console (10) for receiving the RFID-element comprises a cylindrical or square housing shape, wherein the housing length substantially corresponds to the width of the game pad, so that the game pad can be wrapped around the housing for transportation purposes.

4. An assembly according to claim 3, wherein the local console (10) is provided water spray protected.

5. An assembly according to claim 1, wherein the transmitter/receiver unit included in the local console (10) realizes a wireless data transmission through a standardized interface.

6. An assembly according to claim 1, wherein the game pad (20) in another embodiment is provided as a game board, which can be coupled with additional game pads for forming a game field of any size.

7. An assembly according to claim 1, wherein the local console (10) comprises an internal programmable data processing device for performing a game on the game pad (20), coupled with the transmitter/receiver unit (8).

8. An assembly according to claim 1, wherein a skin housing (40), which can be placed onto the local console (10), and/or the game pad (20), and/or a game board skin (45), which can be placed, is provided.

9. An assembly according to claim 8, wherein the skin housing (40) comprises one or several skin keys (41), which are in mechanical contact with key elements (12) on the transmitter/receiver unit (10).

10. An assembly according to claim 1, wherein the information stored on the data carriers is encrypted and the data carriers comprise a unique and unchangeable data carrier identifier, in particular a serial number.

11. An assembly according to claim 1, wherein the local console (10) comprises a sensor assembly (C), in particular for a bright/dark state (C1) and/or biometric fingerprint recognition (C2).

12. An assembly according to claim 1, wherein the local console (10) comprises a device for generating acoustic signals, in particular language and/or sound signals and/or a speech recognition device.

13. An assembly according to claim 1, wherein the game cards (30) and/or the game figures (50) comprise transponder devices with individually provided inductivities, which can be differentiated by antenna coil devices in the game pad.

14. An assembly according to claim 2, wherein the local console (10) for receiving the RFID-element comprises a cylindrical or square housing shape, wherein the housing length substantially corresponds to the width of the game pad, so that the game pad can be wrapped around the housing for transportation purposes.

15. An assembly according to claim 2, wherein the transmitter/receiver unit included in the local console (10) realizes a wireless data transmission through a standardized interface.

16. An assembly according to claim 3, wherein the transmitter/receiver unit included in the local console (10) realizes a wireless data transmission through a standardized interface.

17. An assembly according to claim 4, wherein the transmitter/receiver unit included in the local console (10) realizes a wireless data transmission through a standardized interface.

18. An assembly according to claim 2, wherein the game pad (20) in another embodiment is provided as a game board, which can be coupled with additional game pads for forming a game field of any size.

19. An assembly according to claim 3, wherein the game pad (20) in another embodiment is provided as a game board, which can be coupled with additional game pads for forming a game field of any size.

20. An assembly according to claim 4, wherein the game pad (20) in another embodiment is provided as a game board, which can be coupled with additional game pads for forming a game field of any size.

* * * * *